United States Patent [19]

Duboc et al.

[11] 4,118,836

[45] Oct. 10, 1978

[54] DEVICE FOR FIXING THE ELECTRODES OF ELECTROSTATIC DUST PRECIPITATOR FILTERS

[75] Inventors: Jean Duboc, Maurepas; Bernard Poitier, Paris, both of France

[73] Assignee: Ceca S.A., France

[21] Appl. No.: 806,500

[22] Filed: Jun. 14, 1977

[30] Foreign Application Priority Data

Jun. 17, 1976 [FR] France ..... 76 18455

[51] Int. Cl.[2] ..... A44B 21/00

[52] U.S. Cl. ..... 24/73 SA; 204/279; 209/127 R

[58] Field of Search ..... 24/73 R, 73 BP, 73 B, 24/73 C, 73 SA; 209/127 R; 204/279, 280, 286, 287

[56] References Cited

U.S. PATENT DOCUMENTS

| | | | |
|---|---|---|---|
| 2,712,917 | 7/1955 | Flora et al. | 24/73 SA |
| 3,066,900 | 12/1962 | Holton | 24/73 SA |
| 3,901,480 | 8/1975 | Basile et al. | 24/73 SA |

*Primary Examiner*—Louis K. Rimrodt

[57] ABSTRACT

The present invention relates to a metallic device for fixing discharge electrodes on a frame and cross-pieces so as to constitute elements of electrostatic dust precipitator filters, comprising at least one resilient portion for elastically fixing said device on said frame, and a flat portion, connected to said resilient portion, which holds the electrode in place by elastic pressure between itself and said frame, when the resilient portion has been positioned on the frame.

4 Claims, 13 Drawing Figures

FIG. 1
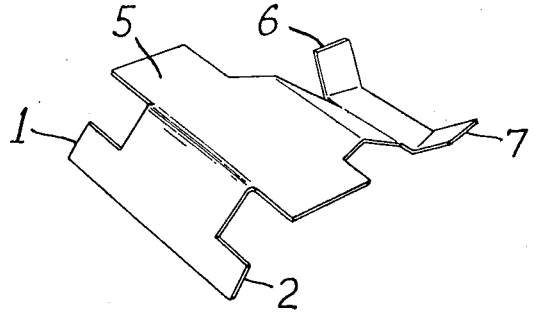
FIG. 2
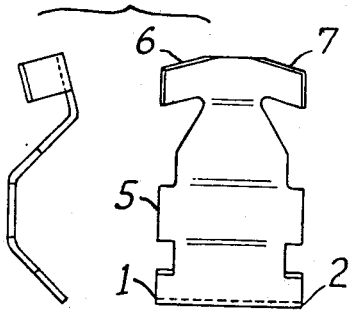
FIG. 3
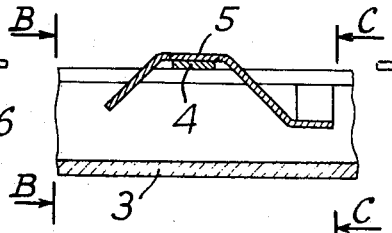
FIG. 4
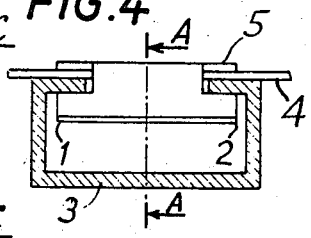
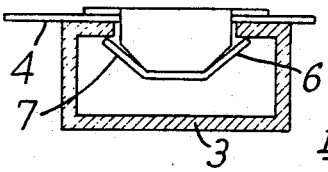
FIG. 5
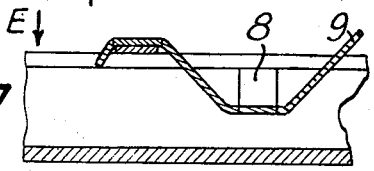
FIG. 7
FIG. 6
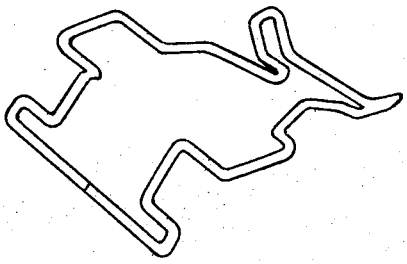
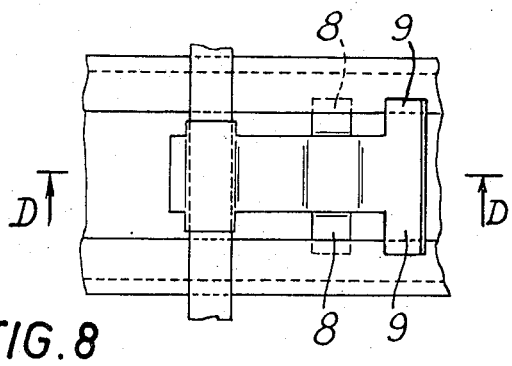
FIG. 8

DEVICE FOR FIXING THE ELECTRODES OF ELECTROSTATIC DUST PRECIPITATOR FILTERS

The present invention relates to a device for fixing the discharge electrodes of electrostatic dust precipitator filters.

Electrostatic dust precipitators enable the fine dust in the air or gases to be eliminated. The result is obtained by causing the air or gas which is to be purified to pass into a chamber where discharge electrodes, charged to a high potential, and collector electrodes are disposed. To this end, the discharge electrodes are connected to the negative polarity of a high voltage D.C. source such that the potential of the electrodes is higher than the ionization potential. Under the influence of the electric field thus created, the dust is polarized and is directed towards the collector electrodes where they lose their charge and are collected.

The device currently used comprises plates as collector electrodes, and parallel wires or strips as discharge electrodes.

A discharge wire or strip may reach a length of 10 meters and a plurality of wires are mounted in parallel, spaced apart by 20 to 30 cm, supported by a frame.

A normally rectangular frame is constituted by two parallel uprights connected at each of their ends by two parallel cross-pieces between which are stretched the wires or strips constituting the discharge electrodes. A frame may thus measure 6 by 10 meters and a plurality of frames may be disposed side by side; frames of discharge electrodes and collector plates may also be alternated in parallel, the whole being mounted in a casing which may be a very large dimensions.

In order to facilitate the dislodging of the dust deposited on the collerctor electrodes, said latter or periodically struck by a suitable rapping mechanism, which causes the dust to be dislodged. Dust is also noted to deposit on the discharge electrodes and the frames supporting these electrodes should also be periodically struck by a similar rapping mechanism.

It has appeared that, if the shocks caused by rapping were transmitted by the solid frame to the ends of the wires or strips fixed to the cross-pieces, the repercussion over the whole length of the wires was poor. The remedy consisted in fixing on the frame a plurality of intermediate cross-pieces parallel to the two end cross-pieces and in fixing the wires or strips on these cross-pieces.

Tubes or bars are usually used for making the frames; the intermediate cross-piece are also made of such materials.

The wires or strips, designated hereinafter as electrodes for greater convenience, are fixed to these intermediate cross-pieces in different ways:

hooks, fast with the intermediate cross-piece or the electrode, fixing in rings, holes, etc. . . fast with the electrode or intermediate cross-piece;

pin holding the electrode passing in a hole in the cross-piece;

bolt and nut holding the electrode, by a clip, against the cross-piece;

screws.

These various means present drawbacks : the hook system is complicated, the pins are liable not to remain in position, the bolts and screws unscrew with use, which makes it necessary to weld them, thus involving a complementary operation.

Moreover, it is ascertained that, whatever the known mode of fixation used, the electrodes break very often. These breakages which are due to said electrodes being subjected to frequent vibrations, due to the mechanical shocks, almost always occur at the points where said electrodes are fixed to the crosspieces; these points form in fact vibration nodes and the metal of said electrodes is subjected to considerable stresses.

It has therefore appeared desirable to develop and perfect a novel device for fixing these discharge electrodes on the cross-pieces of the frame, which device is easier to use than the presently known devices and which avoids the various drawbacks mentioned for the known devices.

It is the object of the present invention to provide such a device, which, according to the invention is a metallic device comprising:

at least one resilient portion for elastically fixing said device on the bar which constitutes the frame or a crosspiece of an electrostatic dust precipitator;

a flat portion, connected to said resilient portion, which holds the electrode in place by elastic pressure between itself and the bar when the resilient portion has been positioned.

The resilient portion may take various forms depending on the shape of the bar or the cross-piece on which it is to be adapted. The essential, according to the invention, is that said portion is positioned and fixed on said bar or said cross-piece only by using the elastic properties of said portion, i.e. without using external elements such as screws, bolts, etc. . .

The device according to the invention holds the electrode in place solely by pressure of said electrode between the flat portion of the device and the bar or cross-piece.

Of course, the pressure must be sufficient for the electrode to be held in place on said bar or said cross-piece but it must not be excessive, i.e. it must, due to a very slight lateral movement, enable the vibrations transmitted to the electrodes by the mechanical shocks to be absorbed. To obtain this suitable pressure, the elasticity of the fixing device may come into play or the contact surface between the electrode, the device according to the invention and the bar (or cross-piece) on which the device holds said electrode in place.

The devices according to the invention may be made of solid or idented sheet metal or may be constituted by a wire to which the suitable shape has been given.

The invention will be more readily understood on reading the following description given by way of non-limiting example with reference to the accompanying drawings, in which:

FIG. 1 is a perspective view of a fastening device, or clip, with lugs at the two ends, for fixation inside the C-section.

FIG. 2 shows a front view and side view of the clip.

FIGS. 3, 4 and 5 show three sections through the section-clip-electrode system; FIG. 3 is a longitudinal section along A—A, FIG. 4 being a view along B—B and FIG. 5 a view along C—C.

Figure 9:
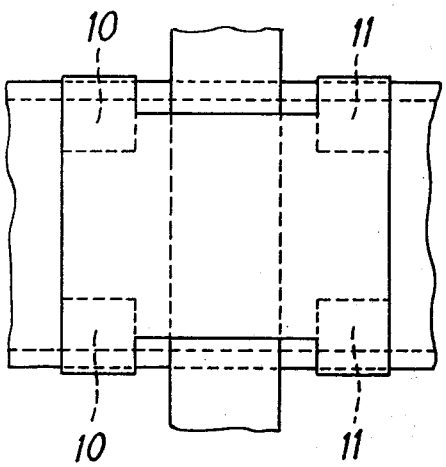

The clip is firstly introduced by its lugs 1 and 2 inside the section 3, the electrode 4 is covered by the flat portion 5 of the clip, then the lugs 6 and 7 are forcibly introduced and abut on the inner flanges of the section 3 and the assembly is held in position.

This type of clip could also be manufactured from indented sheet metal.

FIG. 6 is a perspective view of a similar clip made of wire.

FIG. 7 shows a section along D of a clip and FIG. 8 shows a view along E thereof; this type of clip comprises lugs only at one end, acting on one side of the electrode; the two lugs 8 act in one direction and the two lugs 9 act in the opposite direction.

Figure 10:
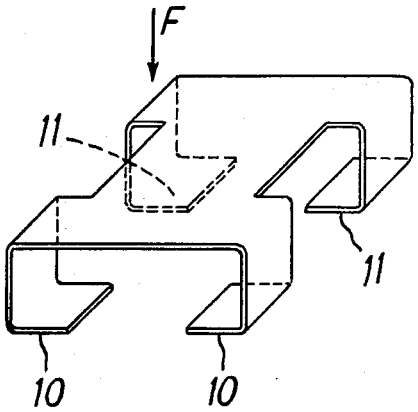

FIG. 9 shows a view along F of a clip and FIG. 10 is a perspective view thereof; this clip is fixed externally on the section by its lugs 10 and 11 on either side of the electrode.

Figure 11:
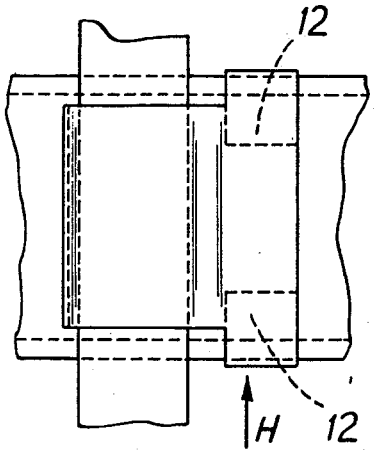
Figure 12:
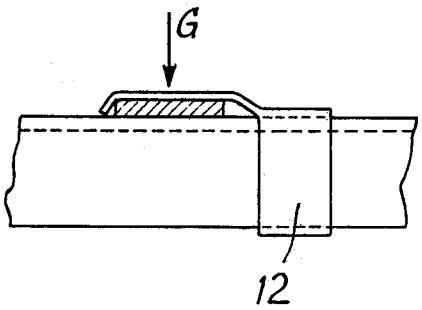

FIG. 11 shows a view along G of a clip and FIG. 12 is a view thereof along H; this type of clip comprises only two lugs 12 on one side of the electrode.

The clips shown in FIGS. 7 to 12 may be manufactured from wire or indented sheet metal instead of solid sheet metal.

Figure 13:
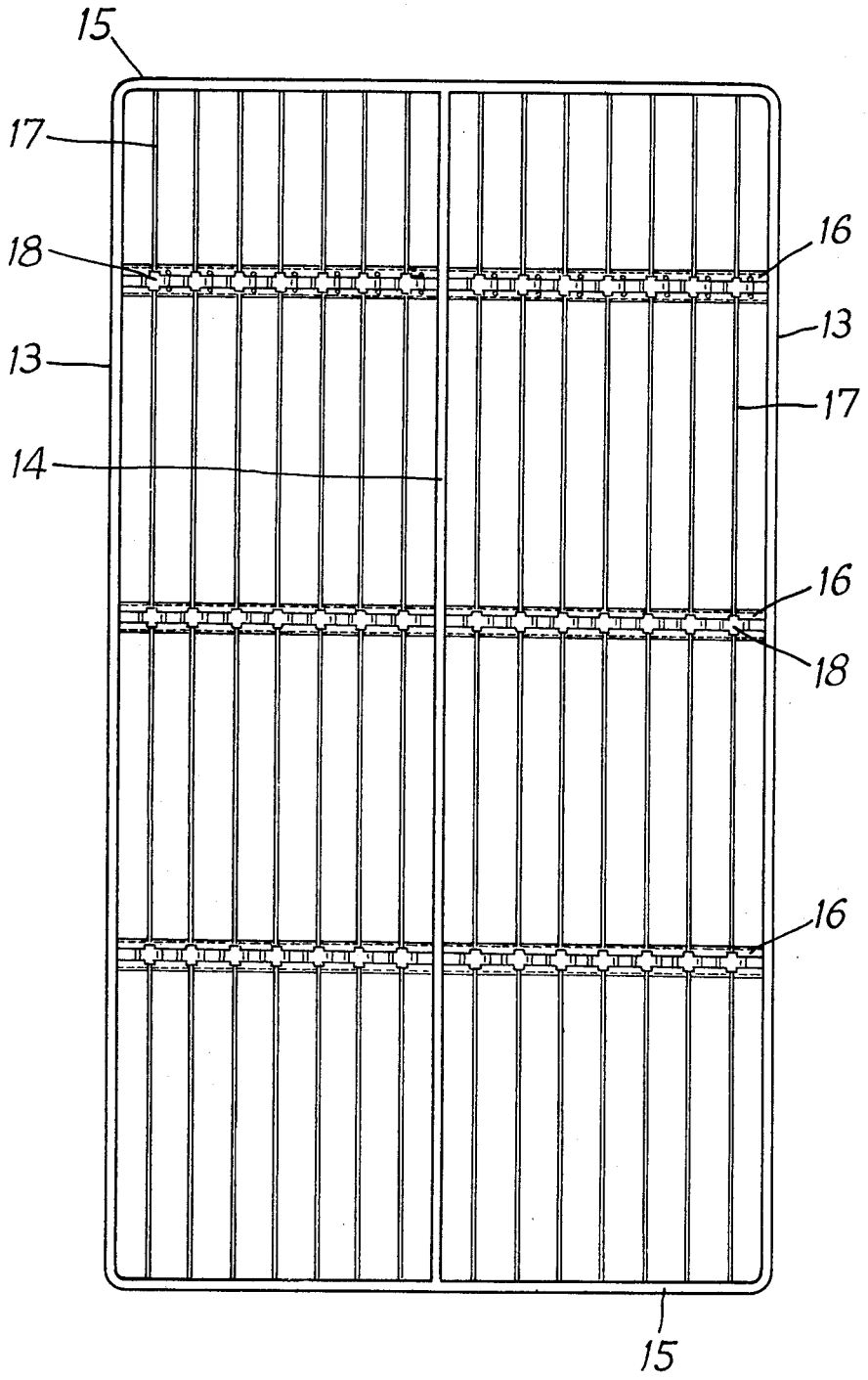

FIG. 13 shows a frame comprising two uprights 13 as well as an intermediate upright 14, two end cross-pieces 15 and the intermediate cross-pieces 16 which are one of the means according to the invention. The electrodes 17 are fixed by means of clips 18 on these intermediate cross-pieces 16.

In view of the combination of the means of the cross-piece and the spring clip, the electrodes are rapidly and securely fixed on the cross-pieces.

As has been seen in FIGS. 1 to 12, given by way of example, the clips may be of different shapes provided that they securely and elastically apply the electrode, wire or strip, on the crosspiece.

The clips which have been described may also be used for fixing electrodes on the end cross-pieces.

The elasticity of the device and the pressure exerted by said device on an electrode may be appreciated by indicating:

that the member shown in FIG. 1 is made of steel, standard XCF 70, with a thickness of 1 mm that the electrode which it is desired to fix on the bar 3 has a rectangular cross-section, measuring 4.5 × 1.5 mm, said bar has a width of 30 mm and an opening of about 20 mm; the flat portion 5 of the device according to the invention is 12 mm wide and 30 mm long.

The device according to the invention presents various advantages with respect to known fixing systems, in particular;

easier positioning and dismantling;

no boring of the bars or cross-pieces;

virtually spontaneous adaptation of the device to the variations in temperature;

and the absence (or considerable reduction) of breakages of the electrodes.

What we claim is:

1. In an electrostatic dust precipitator, a discharge electrode and support arrangement comprising a frame, said frame including at least two uprights, two end crosspieces and at least one intermediate cross-piece extending between said uprights, said intermediate cross-piece being C-shaped in cross section and having an opening of given width, and at least one discharge electrode extending between said two end cross-pieces, said discharge electrode being fixed to said intermediate cross-piece by a metal device consisting of a member having:

a flat portion provided with two lugs (1) and (2) inserted within said intermediate cross-piece of C-shaped cross section, a narrow portion, the width of which is smaller than said given width of opening said intermediate cross-piece, an upper portion (5) firmly pressing said discharge electrode against an external portion of said opening of given width, another narrow portion, having a width which is smaller than said opening of given width, and an end portion provided with lugs which have been introduced by elastic deformation inside said intermediate cross-piece and which, when released, are fitted inside said intermediate cross-piece, whereby it has become possible, because of the insertion of two extremities provided with the lugs inside the intermediate cross-piece to press firmly the electrode against an external part of the opening of given width.

2. An arrangement according to claim 1, wherein said at least one discharge electrode comprises a plurality of discharge electrodes extending between said two end cross-pieces, and a plurality of said metal devices, each respective one of said metal devices fixing a respective one of said plurality of discharge electrodes to said intermediate cross-piece.

3. An arrangement according to claim 1, wherein said at least one discharge electrode comprises a plurality of discharge electrodes extending between said two end pieces, wherein said at least one intermediate cross-piece comprises a plurality of intermediate cross-pieces extending between said uprights, and a plurality of said metal devices, each respective one of said metal devices fixing a respective one of said plurality of discharge electrodes to a respective one of said intermediate cross-pieces.

4. A metal device for fixing discharge electrodes on cross-pieces of a frame in such a manner as to constitute electrostatic dust removers, the cross-pieces being constituted by a bar of C-shaped cross section and having an opening of given width, the device consisting of a metal member having:

a flat portion provided with lugs (1) and (2) adapted to be inserted within the bar of C-shaped cross section, a narrow portion, the width of which is smaller than the opening of given width of the bar, an upper portion (5) which is to press firmly the electrode against an external portion of the opening of given width of the bar, another narrow portion, having a width which is smaller than the opening of given width, and an end portion provided with lugs which can be introduced by elastic deformation inside the bar of C-shaped cross section and which, when released, are fitted inside the bar, whereby the device makes it possible, because of the insertion of two extremities provided with lugs inside the bar of C-shaped cross section to press firmly the electrode against an external part of the opening of given width.

* * * * *